US006393781B1

(12) United States Patent
Sorkin

(10) Patent No.: US 6,393,781 B1
(45) Date of Patent: May 28, 2002

(54) POCKETFORMER APPARATUS FOR A POST-TENSION ANCHOR SYSTEM AND METHOD OF USING SAME

(76) Inventor: Felix L. Sorkin, 4115B Greenbriar Dr. P.O. Box 1503, Stafford, TX (US) 77477

( * ) Notice: Subject to any disclaimer, the term of this patent is extended or adjusted under 35 U.S.C. 154(b) by 0 days.

(21) Appl. No.: 09/523,940

(22) Filed: Mar. 13, 2000

(51) Int. Cl.[7] ..... E04C 5/12
(52) U.S. Cl. ..... 52/223.13
(58) Field of Search ..... 52/223.13; 285/331, 285/339, 421; 403/366, 367, 368, 370, 374.1, 374.3; 411/185, 186, 187, 395, 435, 427

(56) References Cited

U.S. PATENT DOCUMENTS

| | | | | |
|---|---|---|---|---|
| 1,697,602 A | * | 1/1929 | Kukla | 411/249 |
| 3,605,361 A | * | 9/1971 | Howlett | 52/223.13 |
| 3,844,697 A | | 10/1974 | Edwards | |
| 3,956,797 A | | 5/1976 | Brandestini et al. | |
| 4,053,974 A | | 10/1977 | Howlett et al. | |
| 4,363,462 A | * | 12/1982 | Wlodkowski | 249/190 |
| 4,773,198 A | * | 9/1988 | Reinhardt | 52/223.13 |
| 5,436,425 A | | 7/1995 | Sorkin | |
| 5,755,065 A | * | 5/1998 | Sorkin | 52/223.13 |
| 5,897,102 A | | 4/1999 | Sorkin | |
| 6,040,546 A | | 3/2000 | Sorkin | |

* cited by examiner

*Primary Examiner*—Beth A. Stephan
(74) *Attorney, Agent, or Firm*—Harrison & Egbert

(57) ABSTRACT

A pocketformer apparatus for post-tension construction including an anchor member having a wedge-receiving cavity therein, a tubular member having a portion extending through the wedge-receiving cavity, a first securement member affixed to a first end of the tubular member, a cup member positioned over the tubular member, and a second securement member affixed to a second end of the tubular member. The cup member is interposed between the second securement member and the anchor member. The tubular member also extends through a hole in a form board. The second securement member is positioned on one side of the form board. The cup member and the anchor member are positioned on an opposite side of the form board. A tendon extends through the tubular member.

3 Claims, 5 Drawing Sheets

POCKETFORMER APPARATUS FOR A POST-TENSION ANCHOR SYSTEM AND METHOD OF USING SAME

TECHNICAL FIELD

The present invention relates to post-tension anchor systems generally. More particularly, the present invention relates to pocketformers which are used for the creation of a pocket in concrete adjacent an end of the tendon in the anchor system. Additionally, the present invention relates to devices for securing the pocketformer in place at the end of the anchorage system.

BACKGROUND ART

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures ofreinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off t he form work. The size an number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Prestressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

In such post-tension construction, the tendons are anchored and cut off just inside the face of the structure in what are termed "pockets". The "pockets" surrounding the tendon end are filled with a concrete grout. A "pocketformer" is placed in the concrete adjacent to the face of the structure and against an end of the terminal anchor. After the concrete is suitably hardened, a form board is removed and the pocketformer is removed so as to expose the pocket. The ends of the tendon extend outwardly of the pocket. After the tensioning has occurred, the pocket is then filled with a concrete grout so as to be flush with the face of the structure.

FIG. 1 shows a pocketformer 10 as used in the prior art. This pocketformer 10 has a frustoconical surface 12 formed on the exterior of the pocketformer 10. The frustoconical shape 12 will define the pocket. A central tubular member 14 is formed within the interior of the frustoconical portion 12. One end 18 of the tubular member 14 will extend into the central bore of the anchor. The interior 16 of the tubular member 14 will allow the tendon to extend therethrough. Struts 20 extend between the tubular member 14 and the frustoconical portion 12. The tubular member 14 is generally centered within the interior of the frustoconical portion 12. The surface of the anchor will abut the narrow end of the frustoconical portion 12. The wide end of the frustoconical portion will abut a surface of a form board. The tubular member 14 extends through a hole formed in the form board. As such, the tendon will extend outwardly of the form board during the formation of the concrete structure.

One of the problems with the pocketformer 10, as shown in FIG. 1, is the inability to properly secure the anchor relative to the pocketformer 10. In conventional practice, long threaded members will extend through holes in the anchor member and be attached to the form board. After the concrete is hardened, it will be necessary to remove the threaded members or nails. If these items are not removed, then corrosion can occur and rust patterns will form on the facing surface of the concrete structure. Furthermore, the use of nails or threaded members for securing the anchor relative to the form board is a time consuming and labor-intensive operation. As such, a need has developed so as to allow the anchor to be removably secured to the pocketformer during the installation of the pocketformer.

In the past, various patents have issued relating to pocketformers that serve to retain the pocketformer in place, against the form board, during the installation of the anchor. For example, U.S. Pat. No. 3,844,697, issued on Oct. 29, 1974 to H. J. W. Edwards describes an anchorage assembly including an anchor having a hollow housing and a means therein for engaging a stressing tendon passing therethrough. The hollow member is removably attached to the anchor housing and to the concrete formwork and fixing the relative position of the anchor housing to the formwork. The member surrounds the tendon between the anchor housing and the formwork and is adapted and arranged to be detached from the anchor housing after the concrete has set. A cavity forming spacer is provided which surrounds the member and is disposed between and seals against the anchor housing and the formwork to form a cavity in the concrete.

U.S. Pat. No. 3,956,797, issued on May 18, 1976 to Brandestini describes a pocketformer apparatus in which the pocketformer is initially threaded into the interior opening of a steel anchor. As such, the steel anchor will have internal threads which threadedly receive the external threads on the end of the pocketformer. The pocketformer includes an interior bore through which the tendon passes. On the opposite end of the pocketformer is a threaded section which extends on an opposite side of the form board from the anchor. A threaded nut is threadedly received by the threads of the pocketformer which extend on the opposite side of the form board.

U.S. Pat. No. 4,053,974, issued on Oct. 18, 1977 to Howlett et al. describes a method of forming a concrete structure with a recess to receive an anchorage. This method includes a tubular mounting means mounted to extend over the tendon and through an opening in a bearing or anchor plate in order to secure the bearing plate in a fixed position aligned in relation to the tendon for casting the bearing plate into the concrete member in a predetermined orientation. A spacing means is provided between the form board and the anchor plate so as to allow the anchor plate to be cast into a recess in the concrete member.

U.S. Pat. No. 4,363,462, issued on Dec. 14, 1982 to Wldodkowski et al. teaches a formwork for a concrete structural member. This device includes a recoverable formwork part. The recoverable part has an axially elongated sheath which closely encloses a tendon. A cup-shaped part is formed integrally with the sheath and is arranged to form at least a portion of the recess in the concrete member. When assembled on the formwork, one end of the sheath is arranged to be located within the concrete when it is poured and the other end is located on the exterior of the formwork. The cup-shaped part is located intermediate of the ends of the sheath and just inside the formwork. A member is engageable with the sheath for attaching it to the formwork.

U.S. Pat. No. 5,897,102, issued on Apr. 27, 1999 to the present inventor, describes a pocketformer apparatus for a post-tension anchor system. This pocketformer apparatus includes a tubularmember with an outwardly flanged end, a securement member affixed to the tubularmember, and a cup member having an interior opening such that the tubular member extends through the interior opening. The tubular member has an interior passageway extending from the flanged end to another end. The flanged end engages an anchor of the post-tension anchor system. The cup member is interposed between the flanged end and the securement member on the tubular member. The tubular member has an externally threaded area extending inwardly of the end opposite the flanged end. The securement member is threadedly received by the externally threaded area. An annular ring is formed on the flanged end of the tubular member so as to engage a receptacle formed in the encapsulation of the anchor. The securement member, the cup member and the tubular member are formed of a polymeric material.

Although the system described in U.S. Pat. No. 5,897,102 has performed well in actual usage, the system described in this patent is particularly adapted for use in association with an encapulated anchor. In particular, the flanged end of the tubular member engages the cap-receiving opening at the end of the encapsulation of the anchor member. In certain circumstances, certain construction requirements specify the use of a unencapsulated anchor. When such construction projects are specified, the system described in U.S. Pat. No. 5,897,102 cannot be adequately utilized. As such, a need has developed so as to provide a nailless pocketformer system whereby the system would accommodate unencapsulated anchorages.

U.S. Pat. No. 5,436,425, issued on Jul. 25, 1995 to the present inventor, describes a system whereby the tendon can be properly cut by using a plasma cutting torch. The present inventor is also the owner of U.S. application Ser. No.: 09/317,097, filed on May 23, 1999, for another system for the cutting of a tendon used in post-tension anchor systems. These systems utilize a plasma cutting torch which utilizes a positioning element for interconnecting the head of a plasma cutting torch with a tendon to be severed. The pocket into which the plasma cutting torch and positioning element are inserted has a particular configuration so as to allow enough space for the apparatus. In actual use, the product described in this patent and this patent application has been very successful. As such, a need has existed for the use of such a plasma cutting torch in association with unencapsulated anchor systems.

It is an object of the present invention to provide a pocketformer system which allows the anchor to be properly secured in place relative to the form board.

It is another object of the present invention to provide a pocketformer system whereby an unencapsulated anchor can be properly positioned relative to the form board without the use of nails.

It is a further object of the present invention to provide a pocketformer system whereby a pocket is formed which allows a plasma cutting torch and associated positioning elements to be used for the severing of the tendon in the pocket.

It is a further object of the present invention to provide a pocketformer system which eliminates the need for nails or threaded members for the attachment of the anchor relative to the form board.

It is still another object of the present invention to provide a pocketformer system which is easy to use, relatively inexpensive and easy to manufacture.

These and other objects and advantages of the present invention will become apparent from a reading of the attached specification and appended claims.

SUMMARY OF THE INVENTION

The present invention is a pocketformer apparatus for post-tension construction which comprises an anchor member having a wedge-receiving cavity, a tubular member extending through the wedge-receiving cavity, a first securement member affixed to a first end of the tubular member, a cup member extending over the tubular member, and a second securement member affixed to a second end of the tubular member. The cup member is interposed between the second securement member and the anchor member. The tubular member extends through a hole in a form board. The second securement member is positioned on one side of the form board. The cup member and the anchor member are positioned on an opposite side of the form board.

The second end of the tubular member extends outwardly of one side of the form board. The second securement member is affixed to the second end of the tubular member so as to have a surface in abutment with one side of the form board. The cup member has a wide end and a narrow end. The wide end of the cup member is in surface-to-surface contact with the opposite side of the form board. The narrow end of the cup member has positioning elements extending outwardly therefrom. The anchor member is received between the positioning elements such that the wedge-receiving cavity is in axial alignment with the interior opening of the cup member.

In the present invention, the anchor member is, preferably, an unencapsulated steel anchor.

In the present invention, the wedge-receiving cavity of the anchor member is tapered so as to have a narrow end adjacent to one side of the anchor member and a wide end adjacent an opposite side of the anchor member. The tubular member has a portion which is tapered so as to conform with the taper of the wedge-receiving cavity. The first securement member is of an annular configuration and is threadedly secured to the first end of the tubular member. The first securement member has a rim portion of greater thickness than a remainder of the first securement member.

In the present invention, a tendon extends through the tubular member. The second securement member is threadedly secured around the second end of the tubular member. In the preferred embodiment of the present invention, the cup member will have a double oval shape.

The present invention is also a method for the forming of a pocket in a concrete structure. This method comprises the steps of: (1) placing a tubular member through a wedge-receiving cavity of an anchor member such that a first end of the tubular member extends outwardly of a side of the anchor member; (2) affixing a first securement member onto the first end of the tubular member; (3) positioning a cup member over the tubular member such that a narrow end of the cup member faces an opposite side of the anchor member; (4) extending the tubular member through a hole in the form board such that a wide end of the cup member faces one side of the form board and such that a second end of the tubular member extends outwardly of an opposite side of the form board; (5) affixing a second securement member over the second end of the tubular member; (6) extending a tendon through the tubular members; (7) pouring concrete over an exterior of the anchor member and the cup member within one side of the form board; and (8) solidifying the concrete.

In particular, in this method, so as to completely form the pocket, the second securement member is removed from the second end of the tubular member and the form board and the cup member are also removed from the tubular member so as to expose a pocket, which is shaped like an exterior surface of the cup member. The tubular member is then pulled from the wedge-receiving cavity of the anchor member. This step of removing the tubular member from the cavity of the anchor member is accomplished by rotating the tubular member so as to threadedly detach the first end of the tubular member from engagement with the first securement member.

DETAILED DESCRIPTION OF THE INVENTION

Figure 1:
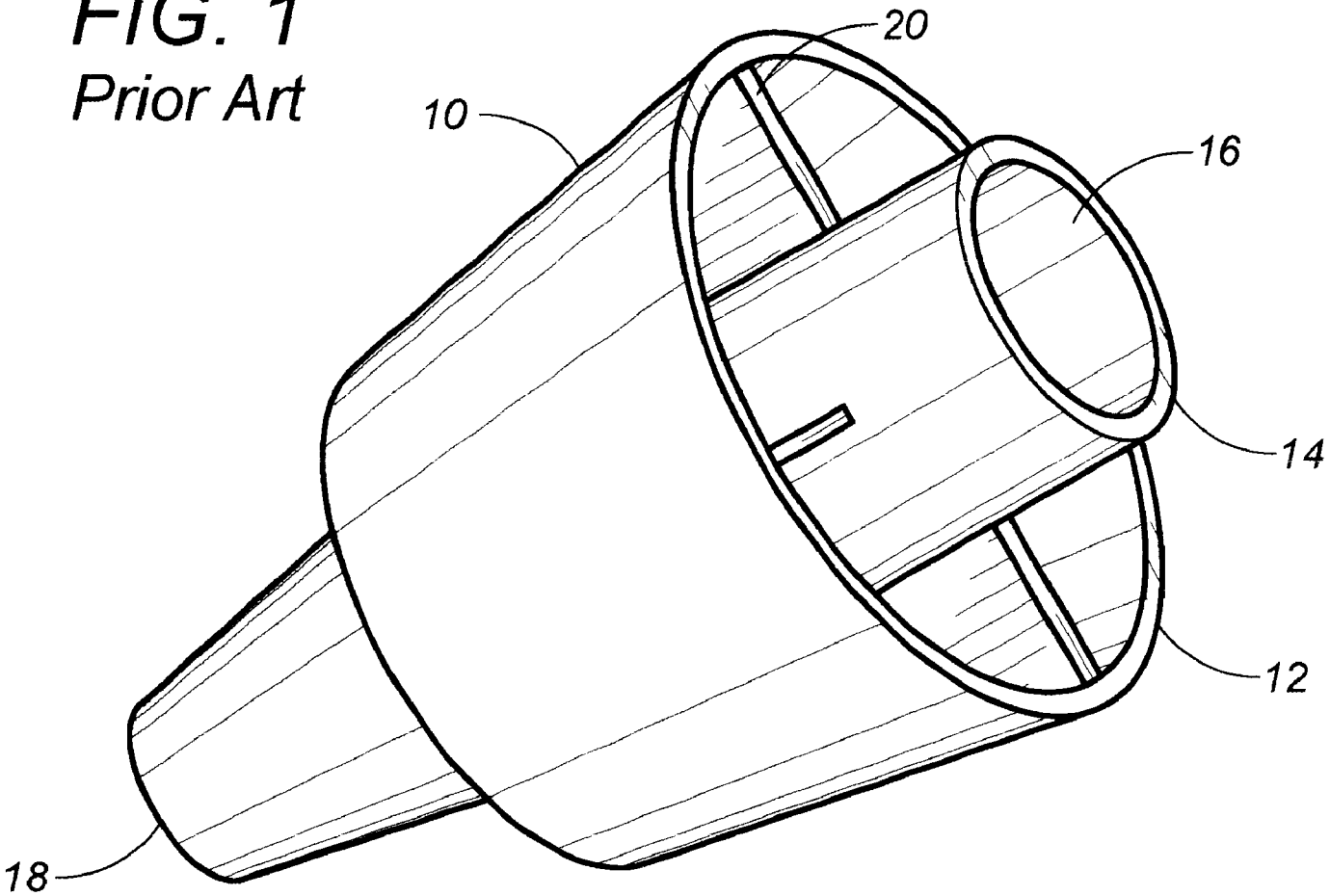
FIG. 1 Prior Art
FIG. 1 is perspective view of a pocketformer as used in the prior art.
Figure 2:
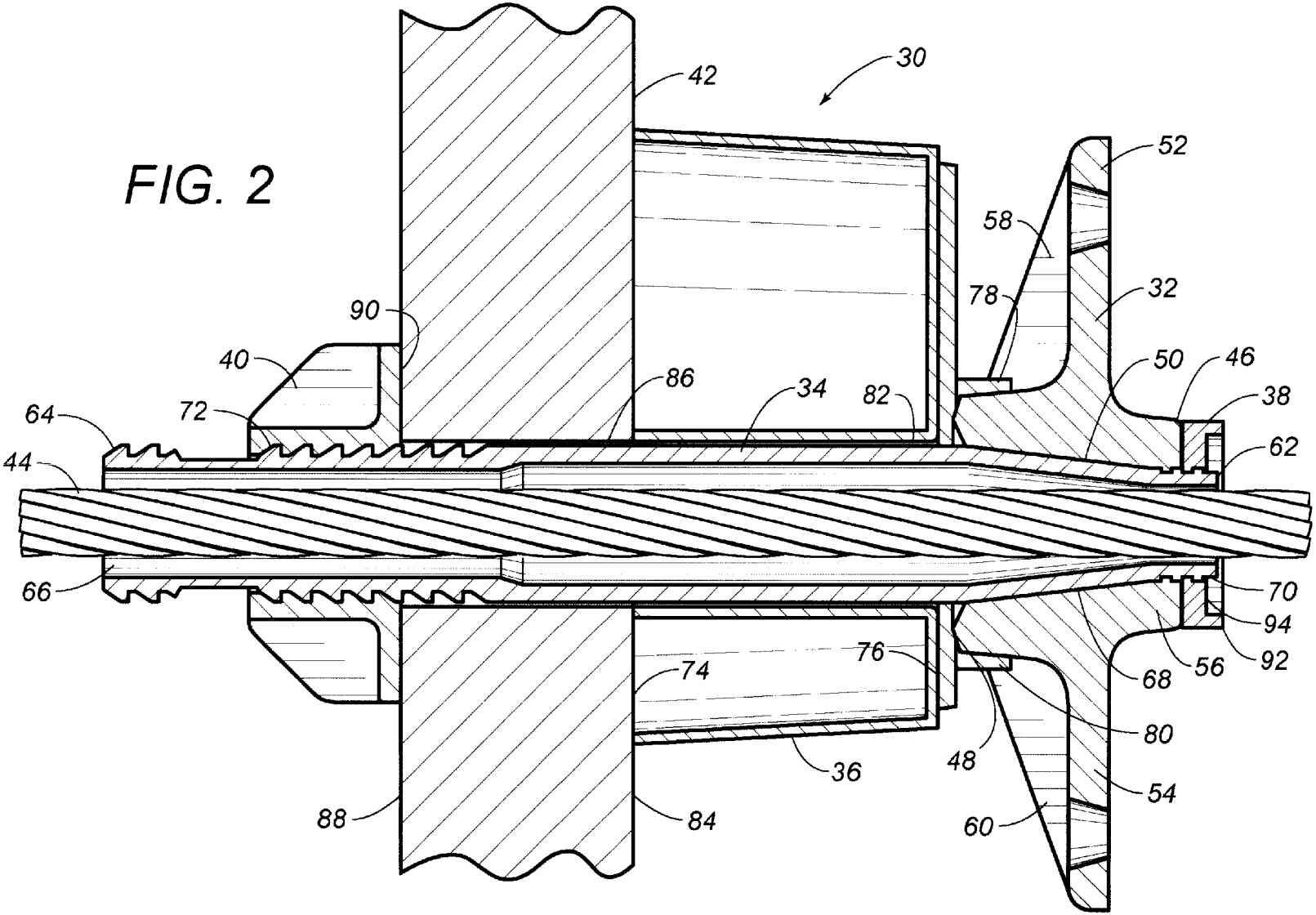
FIG. 2 is a cross-sectional side view of the pocketformer apparatus of the present invention.

Referring to FIG. 2, there is shown the pocketformer apparatus 30 as used in post-tension construction. The pocketformer apparatus 30 includes an anchor member 32, a tubular member 34, a cup member 36, a first securement member 38, a second securement member 40, a form board 42 and a tendon 44. Each of these elements are assembled together so as to provide a particularly useful system for the formation of a pocket in post-tension construction. In the preferred embodiment of the present invention, the anchor 32 is an unencapsulated steel anchor.

As can be seen in FIG. 2, the anchor member 32 has a first end 46 and an opposite end 48. A tapered wedge-receiving cavity 50 extends through the interior of the anchor member 32. Anchor member 32 has wings 52 and 54 extending outwardly from a central body portion 56. Gussets 58 and 60 extend from the central body portion 56 to the wings 52 and 54, respectively, for enhancing the strength of the anchor member 32. Anchor member 32 has the configuration of a standard steel unencapsulated anchor used in post-tension construction.

Tubular member 34 has a first end 62 and an opposite end 64. An interior passageway 66 extends from the first end 62 to the opposite end 64. The tubular member 34 has a tapered portion 68 which is sized so as to conform with the tapered wedge-receiving cavity 50 of the anchor member 32. The first end 62 will extend outwardly from the end 46 of the anchor member 32. The end 62 has a threaded surface 70. Threaded surface 70 can have coarse threads so as to allow the first securement member 38 to be threadedly secured thereto at the end 46 of anchor member 32. Similarly, threads 72 are formed at the opposite end 64 of the tubular member 34 so as to threadedly receive the second securement member 40. The threads 72 can have a conventional threaded structure or can have a particularly unique threaded structure, as will be described hereinafter. The tendon 44 will extend through the interior passageway 66 of the tubular member 34.

The cup member 36 is of a hollow construction. The cup member 36 has a wide end 74 and a narrow end 76. Positioning elements 78 and 80 extend outwardly of the narrow end 76 so as to allow the anchor member 32 to have its central body portion 56 received therebetween. The positioning elements 78 and 80 serve to position the anchor member 32 in such a way that the wedge-receiving cavity 50 is axially aligned with the interior opening 82 of the cup member 36.

The cup member 36 is positioned so as to have its wide end 74 in surface-to-surface contact with the surface 84 of the form board 42. In the arrangement in accordance with the present invention, the cup member 36 will be sandwiched between the anchor member 32 and the surface 84 of form board 42. The tubular member 34 will extend through the interior opening 82 and through the hole 86 in the form board 42 such that its opposite end 64 will extend outwardly of the opposite side 88 of the form board 42.

The second securement member 40 is positioned over the threads 72 at the opposite end 64 of the tubular member 34. The second securement member 40 can be threadedly secured so as to have a surface 90 in surface-to-surface contact with the opposite side 88 of the form board 42. The second securement member 40 can be suitably tightened on the threads 72 so as to establish a tight sandwiched relationship between the anchor member 32, the cup member 36, the form board 42 and the securement member 40. The first securement member 38 will serve to fix each of these items relative to the fixed end 62 of the tubular member 34.

Unlike the prior art pocketformer systems described in the patents issued to the present inventor and described hereinbefore, the present invention does not require engagement with the encapsulation of the anchor member. The tubular member 34 is suitably engaged with the anchor member 32 by extending through the wedge-receiving cavity 50 of the anchor member 32 and having the first securement member 38 threadedly engaged on the threads 70 on the first end 62 of the tubular member 34. In FIG. 2, it can be seen that the first securement member 38 has a rim 92 extending around the central body portion 94 of the first securement member 34. Rim 92 will be of greater thickness than the remainder of the first securement member 38. The outwardly extending rim 92 will facilitate the ability to properly attach the first securement member 38 over the end 62 of tubular member 34 by providing a wider surface area for fingers. The central body portion 94 of the first securement member 38 is of minimal thickness so as to avoid any problems with the integrity of the concrete extending therearound.

Figure 3:
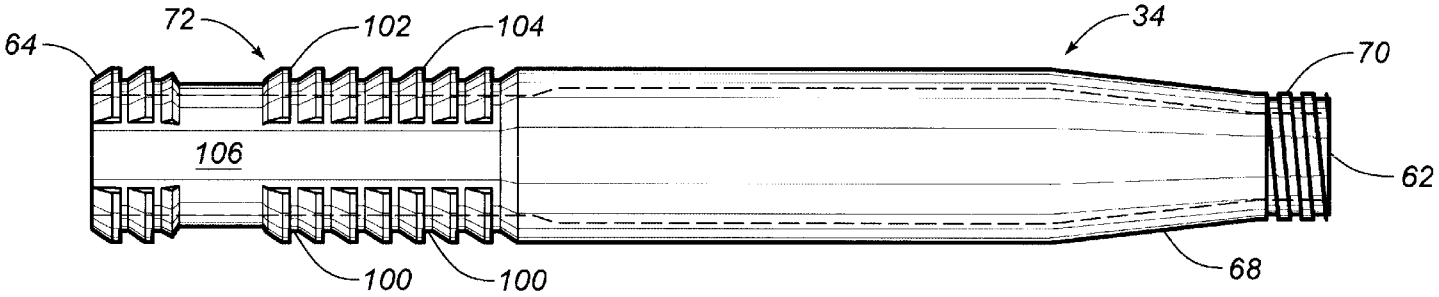
FIG. 3 is a side elevational view showing the tubular member of the present invention.

FIG. 3 shows the configuration of the tubular member 34 as used in the preferred embodiment of the present invention. As can be seen, the tubular member 34 has coarse threads 70 at end 62, a tapered portion 68, and external threads 72 formed at the opposite end 64 of the tubular member 34. These external threads 72 allow the second securement member 40 to be affixed thereover. The threads 72 have a special configuration in the present invention. As can be seen, the threads 72 are parallel threads which are formed on the tubular member 34. A space 100 will occur between adjacent threads 102 and 104. A split 106 is formed along the circumference of each of the threads. The split 106 extends for the length of the threaded section 72 of the tubular member 34. The split 106 allows the threaded portion 72 of the securement member 40 to slide easily along the length of the threaded section 72 until the surface 90 resides against the form board 42. The securement member 40 can be rotated so that the threaded portion on the interior of the securement member 40 will reside in the space between adjacent threads. As such, it is not necessary to continually rotate the securement member 40 so as to draw it into contact with the form board 42. However, within the scope of the present invention, it should be noted that the threaded portion 72 can be of conventional form, square threaded, or otherwise configured so as to allow the securement member 40 to be moved to its desired position.

Figure 4:
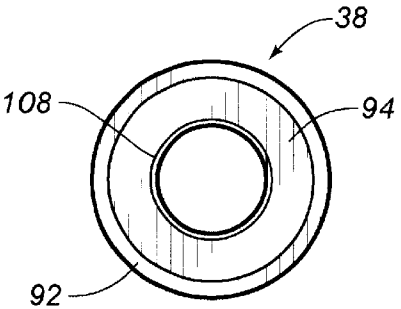
FIG. 4 is an end view of the first securement member as used in the present invention.

FIG. 4 shows the first securement member 38. First securement member 38 has interior threads 108 which will engage the external threads 70 at the end 62 of the tubular member 34. Additionally, the rim 92 extends around the central portion 94 of the first securement member 38. The rim portion 92 allows the first securement member 38 to be easily installed onto and rotated around the threaded portion 70 on the end 62 of the tubular member 34.

Figure 5:
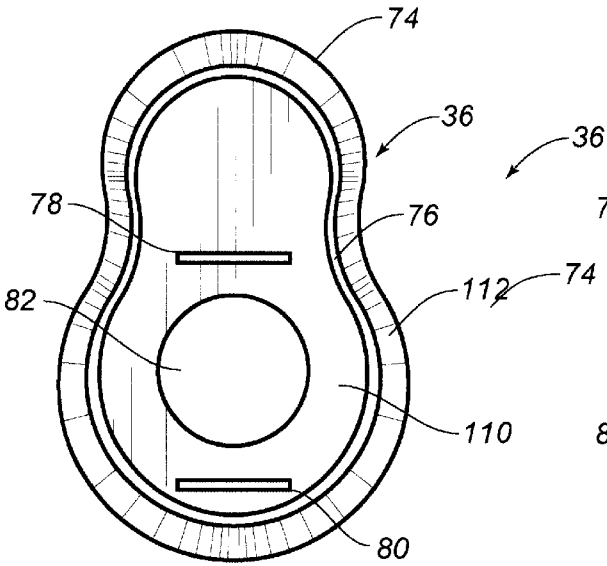
FIG. 5 is an end view of the narrow end of the cup member as used in the present invention.

FIG. 5 is a view of the narrow end 76 of the cup member 36. The cup member 36 has a double oval shape. The face 110 at the end 76 of the cup member 36 is a generally flat face with an interior opening 82 formed therein. It can be seen that the interior opening 82 is offset from the center of the face 110. The side 112 of the cup member 38 extends angularly outwardly so as to terminate at the wide end 74. The tapered narrow end 76 of the cup member 36 facilitates the ability to mold the cup member 36 in an injection molding process. Furthermore, this angled side 112 of the cup member 36 also facilitates to slidably remove the cup member 36 from the concrete after the concrete has solidified.

FIG. 5 shows that the positioning elements 78 and 80 extend outwardly from the face 110 so as to be suitably positioned to center the anchor member 32 such that the wedge-receiving cavity 50 of the anchor member 32 is axially aligned with the interior opening 82 of the cup member 36.

Figure 6:
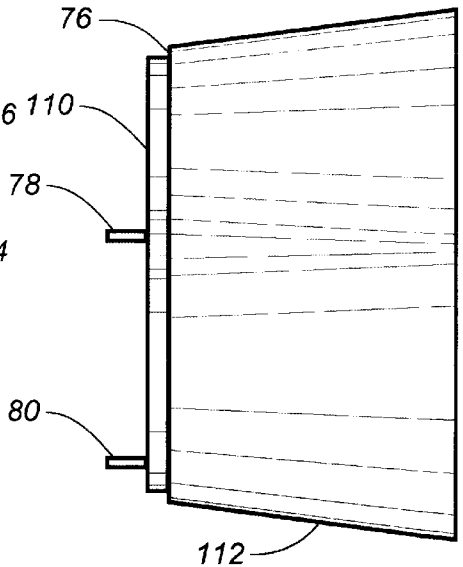
FIG. 6 is an opposite side view of the cup member as used in the present invention.

FIG. 6 shows a side view of the cup member 36. As can be seen, side 112 tapers inwardly from the wide end 74 to the narrow end 76. Positioning elements 78 and 80 are formed on the face 110 of the cup member 36.

Figure 7:
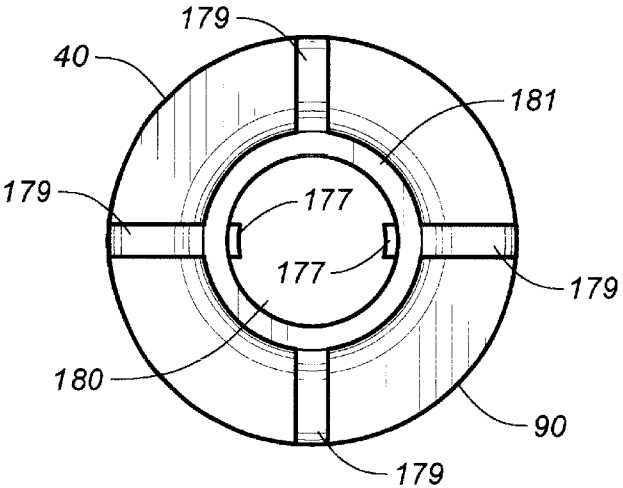
FIG. 7 is an end view of the second securement member as used in the present invention.

FIG. 7 shows an end view of the second securement member 40. It can be seen that the securement member 40 includes internal threaded portions 177. The internal threaded portions 177 engage the external threaded portions 72 of the tubular member 34. Specifically, the threaded portion 177 have a length which will fit through the split 106. The threaded portions 177 will have a thickness suitable for fitting into the space 100. The securement member 40 includes a flat abutment surface 90 which will be in surface-to-surface contact with the side 88 of the form board 42. Gussets 179 will extend from the forward face 181 of the securement member 40 to the flat abutment surface 90. As can be seen, the securement member 40 includes an interior bore 180 which will allow the securement member 40 to be placed over the exterior of the tubular member 34.

Figure 8:
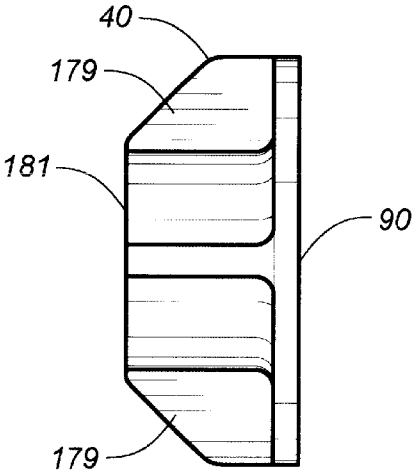
FIG. 8 is a side elevational view of the second securement member as used in the present invention.

FIG. 8 shows a side view of the securement member 40. In particular, it can be seen that the flat abutment surface 90 is formed at one end of the securement member 40. The forward face 181 is at the opposite end of the securement member 40. Gussets 179 extend from the forward face 181 to the flat abutment surface 90. The gussets 179 facilitate the ability to properly position the securement member 40 around the threaded portion 72 of the tubular member 34.

Figure 9:
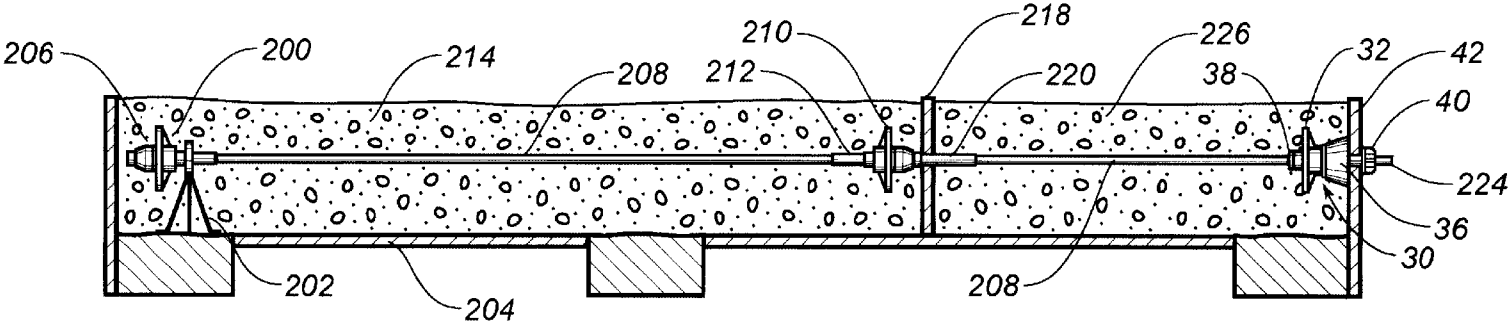
FIG. 9 is a diagrammatic illustration of the installation of the pocketformer apparatus of the present invention.

FIG. 9 shows the installation of the pocketformer apparatus 30 of the present invention. Initially, in the art of post-tension construction, it can be seen that a dead end anchor 200 is positioned on a support 202 above face 204. A terminal anchor 200 has a cap 206 including the terminal end of the tendon 208. The terminal end of the tendon 208 is securely affixed within the anchor 200. The tendon 208 will extend from anchor 200 to an intermediate anchorage 210. A corrosion protection tube 212 is placed over the tendon 208 so as to establish a liquid-tight seal between the intermediate anchorage 210 and the exterior of the tendon 208. Concrete 214 is then poured into the area between form board 216 and form board 218. After the concrete 214 has solidified, the tendon 208 can be suitably tensioned between anchor 200 and anchor 210. After the tensioning has occurred, a suitable corrosion protection tube 220 can be installed over the exposed end of the tendon 208 which lies on a side of the form board 218. The tendon 208 will extend through the corrosion protection tube 220 and through the interior of the anchor member 32. It can be seen that the cup member 36 is interposed between the form board 42 and the securement member 40. Tendon 208 will have an end 224 which extends outwardly of the second securement member 40.

Specifically, with respect to the installation of the present invention for the formation of a pocket in the concrete 226 adjacent to the form board 42 (with reference to FIGS. 2 and 9), the end 224 of the tubular member is placed through the wedge-receiving cavity 50 of the anchor member 32 such that the first end 62 of the tubular member 34 extends outwardly of a side of the anchor member 32. A first securement member 38 is affixed onto the first end 62 of the tubular member 34. The cup member 36 is positioned over the tubular member 34 such that a narrow end of the cup member 36 faces the end 48 of the anchor member 32. The tubular member 34 is extended through the hole 86 in the form board 42 such that a wide end 74 of the cup member 36 faces one side of the form board 42 and such that the opposite end 64 of the tubular member 34 extends outwardly of the opposite side 88 of the form board 42. The second securement member 40 is placed over the second end 64 of the tubular member 34. The tendon 44 is then extended through the tubular member 34. Concrete 226 can then be poured over the exterior surface of the anchor member 32 and the cup member 36 within side 84 of the form board 42. Concrete 226 is then solidified. Following the solidification of the concrete 226, the second securement member 40 is removed from the second end 64 of the tubular member 34. The form board 42 and the cup member 36 are then removed from the tubular member 34 so as to expose a pocket, which is shaped like an exterior surface of the cup member 36. The tubular member 34 can then be pulled from the interior wedge-receiving cavity 50 of the anchor member 32. Since, in the preferred embodiment, the tubular member 34 is threadedly secured to the first securement member 38 and since the first securement member 38 is positioned within the solidified concrete 226, it will be necessary to rotate the tubular member 34 so as to threadedly disengage the first end 62 of the tubular member 34 from the first securement member 38. The tendon end 224 will then extend outwardly of this pocket.

Figure 10:
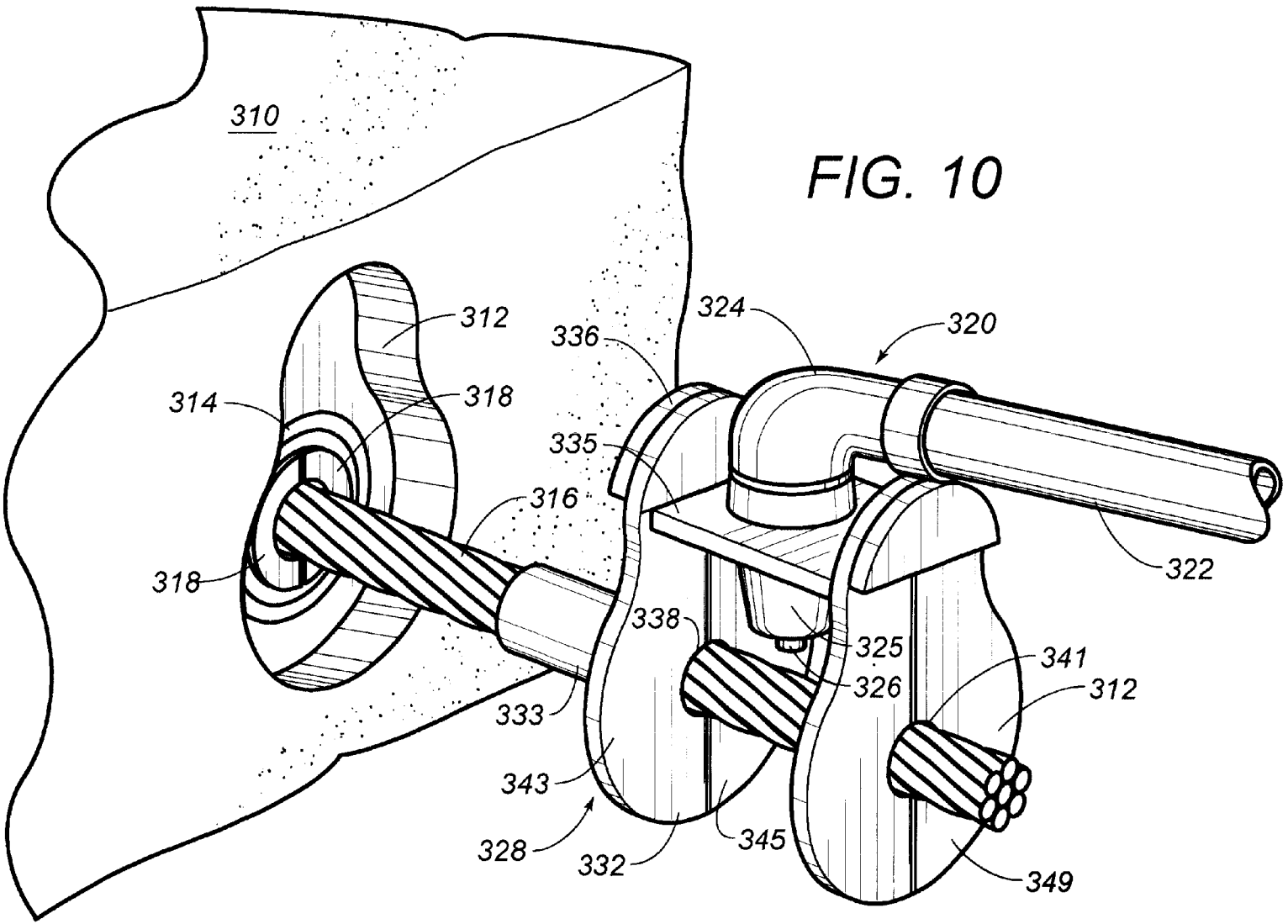
FIG. 10 is a perspective view showing the formation of a pocket in the concrete structure and the technique of using a plasma torch for the severing of the tendon extending outwardly of the anchor member.

FIG. 10 shows the manner of severing a tendon extending outwardly of the peculiarly shaped pocket in concrete. FIG. 10 was originally shown in U.S. patent application Ser. No. 09/317,097, filed on May 23, 1999, by the present inventor. In FIG. 10, it can be seen that a pocket 312 has been formed in a concrete slab 310. The anchor 314 is disposed at the inside face of the pocket 312. The tendon 316 is embedded in the concrete slab 310. The free end of the tendon 316 extends through the anchor 314 and is held in place by wedges 318 seated in the wedge-receiving cavity of the anchor 314 and will be gripping the tendon 316 in the usual manner. In order that the anchor 314, the wedges 318 and the post-tension tendon 316 can be protected from the elements, it is desirable to sever the tendon 316 within the depth of the pocket 312, near to the face of the tendon gripping wedges 318. For this purpose, there is preferably provided a cutting torch 320 of the acetylene or plasma type. The cutting torch 320 is a prior art device which utilizes a gas or plasma stream so as to generate a flame. The flame will be of a sufficient temperature so as to cut through the tendon 316 in a clean and efficient manner.

The torch 320 includes a handle 322, a head 324 and a cutting nozzle 326. A ceramic heat shield 325 surrounds a portion of the tip of the torch 320.

Since the cutting depth of the torch is restricted, and since the cutting down within the pocket 312 in close proximity to the anchor 314, means are provided for accurately positioning an shielding the cutting nozzle of the torch 320 with respect to the tendon 316 and the anchor 314. The particular shape of the pocket 312, formed by the method of the present invention, will enable the cutting head 324 to be properly inserted therein for the cutting of the tendon 316 in close proximity to the anchor 314.

In the system shown in prior application Ser. No. 09/317,097 the positioning and shielding apparatus 328 is releasably engaged with the tendon 316. The apparatus 328 includes a first shield 332, a tubular extension 333, a bracket member 335 and a second shield 337. The first shield 332 has a shape which conforms to the shape of the pocket 312 associated with the concrete slab 310. The first shield 332 has an opening 338 formed therein. As can be seen, the opening 338 is adapted to allow the tendon 316 to extend therethrough. The tubular extension 333 extends outwardly from the first shield 332 at the opening 338. The tubular extension 333 is adapted to extend around the tendon 316 on one side of the first shield 332. The bracket member 335 is affixed to the first shield 332 and is attached to the cutting torch 320 such that the cutting torch 320 has its cutting nozzle 326 resided on an opposite side of the first shield 332 from the tubular extension 333. The second shield 337 is connected to the bracket member 335. The second shield 337 has an opening 341 to which the tendon 316 passes therethrough. The second shield 337 is arranged in spaced parallel relationship to the first shield 332 such that the cutting nozzle 326 is interposed between the first shield 332 and the second shield 337.

As can be seen in FIG. 10, the first shield 332 has a first section 343 and a second section 345. The sections are pivotally connected to one another such that the opening 338 is formed on an inner edge of each of the sections 343 and 345. The second shield 337 also includes a first section 347 and a second section 349. The opening 341 is formed in each of the sections 347 and 349. The sections 347 and 349 are pivotable with respect to each other so as to open and close the second shield 337 by gravity action.

As can be seen by FIG. 10, the present invention provides a technique whereby an unencapsulated steel anchor can be utilized in the concrete slab 310 and a conventional cutting torch can be used for the severing of the tendon within the pocket. As such, the present invention achieves a severing of the tendon within the area of the pocket 312 as close as possible to the face of the anchor 314.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A pocketformer apparatus for post-tension construction comprising:

an anchor member having a wedge-receiving cavity formed therein;

a tubular member having a portion extending through said wedge-receiving cavity, said tubular member having a first end extending outwardly of one side of said anchor member, said tubular member having a second end extending outwardly from an opposite side of said anchor member;

a first securement member threadedly affixed to said first end of said tubular member;

a cup member having an interior opening, said tubular member extending through said interior opening, said cup member having a wide end and a narrow end, said narrow end of said cup member having positioning elements extending longitudinally outwardly therefrom transverse to a plane of an end surface at said narrow end, said anchor member received between said positioning elements such that said wedge-receiving cavity is in axial alignment with said interior opening of said cup member; and a second securement member affixed to said second end of said tubular member, said cup member interposed between said second securement member and said anchor member.

2. The apparatus of claim 1, said wedge-receiving cavity of said anchor member being tapered so as to have a narrow end adjacent to said one side of said anchor member and a wide end adjacent to said opposite side of said anchor member, said portion of said tubular member being tapered so as to conform with the taper of said wedge-receiving cavity.

3. The apparatus of claim 1, said first securement member being of an annular configuration and threadedly secured to said first end of said tubular member.

* * * * *